US005626488A

United States Patent [19]

Albeck et al.

[11] Patent Number: 5,626,488

[45] Date of Patent: May 6, 1997

[54] ELECTRICAL TERMINAL AND COUPLING CONNECTOR

[75] Inventors: Bernhard Albeck, Lorch-Waldhausen; Dieter Hammer, Waiblingen; Christian Gerstberger, Menden, all of Germany

[73] Assignee: Vossloh-Schwabe GmbH, Urbach, Germany

[21] Appl. No.: 412,755

[22] Filed: Mar. 29, 1995

[30] Foreign Application Priority Data

Apr. 20, 1994 [DE] Germany ..... 44 13 643.9

[51] Int. Cl.[6] ..... H01R 4/24

[52] U.S. Cl. ..... 439/395; 439/441; 439/717

[58] Field of Search ..... 439/395, 441, 439/717, 397

[56] References Cited

U.S. PATENT DOCUMENTS

| | | | |
|---|---|---|---|
| 4,036,545 | 7/1977 | Mysiak et al. | 439/395 |
| 5,074,804 | 12/1991 | Pantland et al. | 439/395 |
| 5,129,840 | 7/1992 | Kuzuno et al. | 439/397 |
| 5,163,855 | 11/1992 | Gerke et al. | 439/395 |
| 5,433,626 | 7/1995 | Drewanz et al. | 439/395 |
| 5,480,323 | 1/1996 | Mews et al. | 439/395 |

FOREIGN PATENT DOCUMENTS

| | | | |
|---|---|---|---|
| 1892676 | 5/1964 | Germany . | |
| 7124784 U | 6/1971 | Germany . | |
| 2715861 | 10/1978 | Germany | 439/717 |
| 3813895A1 | 7/1989 | Germany . | |
| 726317 | 3/1955 | United Kingdom . | |
| 1294828 | 11/1972 | United Kingdom | 439/717 |

*Primary Examiner*—Gary E. Elkins

*Attorney, Agent, or Firm*—Frishauf, Holtz, Goodman, Langer & Chick, P.C.

[57] ABSTRACT

An electrical terminal or coupling connector with two spatially separated terminal connections for electrical conductors and having contact elements assigned to the connections comprises at least two parts (2, 3), each of which has at least one connection part (14, 16), and which are positively joined together to make a single unit. At least one connection (18) of this single unit is in the form of a slit-blade insulation piercing connector arranged for automatic wiring. At the same time, the single unit has devices (50, 51) for positive coupling with other single units of the same or different function.

37 Claims, 7 Drawing Sheets

ELECTRICAL TERMINAL AND COUPLING CONNECTOR

FIELD OF THE INVENTION

The present invention relates to an electrical terminal and coupling connector, and more particularly to a connector which has at least two spatially separated terminals adapted for electrical connection with electrical wires, and an insulated housing in or on which the terminals are retained and within which they are internally connected. The connector is particularly suitable for modular construction to provide multi-terminal connections.

BACKGROUND

U.S. application Ser. No. 08/190,131, filed Feb. 3, 1994, issued as U.S. Pat. No. 5,515,606 Albeck et al., discloses a method and apparatus for automatic wiring of terminals of electrical apparatus or components. Terminals and connection clamping elements are used which have a slit-blade insulation piercing (SBIP) connector, particularly adapted for automatic wiring, to form one connection terminal. The electric line, laid by a line laying tool under programmed control along a predetermined line laying path, is automatically pressed into the insulation piercing slit, creating an electrical contact; the line is then optionally cut off directly next to the terminal contact point. The connecting line of the electrical device, such as a capacitor, a lamp socket, or a fluorescent lamp ballast is connected in a manner not shown in further detail and known per se to the electric contact means, containing the insulation piercing slit, which are located in the interior of a housing of insulating material securely protected against being touched. In the embodiment as a coupling connector, the connector device has two spatially separate connection points in the form of SBIP connectors, which are conductively connected to one another by contact means located in the interior of the insulating material housing of the connector. Both SBIP connectors are arranged for automatic wiring, and provisions are made so that the conductor ends, cut off on the two SBIP connectors, are protected in the connector in a manner secure against being touched.

An electric terminal connector device described in European Patent Disclosure EP 0 573 792 A1, corresponding to U.S. Ser. No. 08/190,129, filed Feb. 3, 1994, Albeck et al., is provided with connection points embodied as above. The arrangement may be chosen to be such that the terminal connector device is part of a terminal element that is arranged directly to hold electrical operating means, for instance in that the terminal connector devices are formed onto or otherwise secured to a lamp socket or a base part arranged for the connection of a capacitor.

These terminal connector devices have proven to be excellent in practice. At their SBIP connectors, they assure perfect gas-tight contacting of the electrical conductors for the internal wiring of the wired device, such as an electric light for gas discharge lamps. As long as these devices are produced in sufficiently large-scale mass production with fundamentally the identical design, there are no difficulties involved in designing the terminal connector devices for the particular intended purposes and function and to produce them oneself. Increasingly, however, there is a demand for these terminal or coupling connectors that are suitable for automatic wiring and that make it possible to create different connection possibilities as needed with relatively few individual parts, in order to meet the requirements of an individual situation. With electric lights, for instance, the internal wiring should be done automatically by the SBIP technique, while the connection of the light to the external supply lines of the line power grid should be done via screw connections or screwless terminal contacts, of the kind that have been conventional until now for connecting lights. A further factor is that the internal wiring makes do with electrical conductors to smaller cross section, while the power grid supply lines have the larger line cross sections typical of interior building wiring.

THE INVENTION

It is an object to create terminal and coupling connectors for automatic electric wiring, which with simple, rational manufacture enable adaptation to different situations as needed and thus reduce user inventory to a minimum.

Briefly, the connector has at least two separable parts. Each one of the parts carries at least one terminal. The parts can be interengaged, for example by a snap connection, to form, when coupled together, a single connector unit. At least one of the terminals is constructed in the form of a slit-blade insulation piercing connector, arranged to be connected to an electrical wire by an automatic wiring apparatus. The connected unit, formed of the initially at least two parts, additionally includes arrangements for interengaged coupling with other similar units, which may have a similar or different function, for example different internal or external terminal or connection arrangements.

At least one other terminal may be formed by way of example as a screw connection or as a screwless, e.g. push-in connection, and in particular is arranged for connection of the lines of the external wiring. Regardless of the form this other terminal takes, the connector has devices for interengaged coupling with other single units of identical or different function.

This allows the user, in a further feature of the invention, to assemble multi-pole or multi-wire terminal or coupling connector devices which comprise a plurality of single- or multi-pole single units of this kind; at least some of the single units may have different functions.

Finally, a set according to the invention for producing multi-wire line connectors can also be made available to the user; it comprises a number of single units, in particular of the above type in the form of such single- or multi-pole terminal or coupling connectors, each of which has a plurality of terminals at least one of which is an SBIP connector arranged for automatic wiring, while at least one another terminal is formed as a screw connection or a screwless connection. All the single units have identical, laterally located coupling means, which are arranged for interengaged coupling of single units of the same or different functions, lined up with one another to form multi-pole connectors or connector strips.

These provisions allow the user to make do with an inventory of relatively few individual parts, and on his own to assembly himself the connector devices suitable for the most rational wiring or for a given case as applicable.

DRAWINGS

Figure 1:
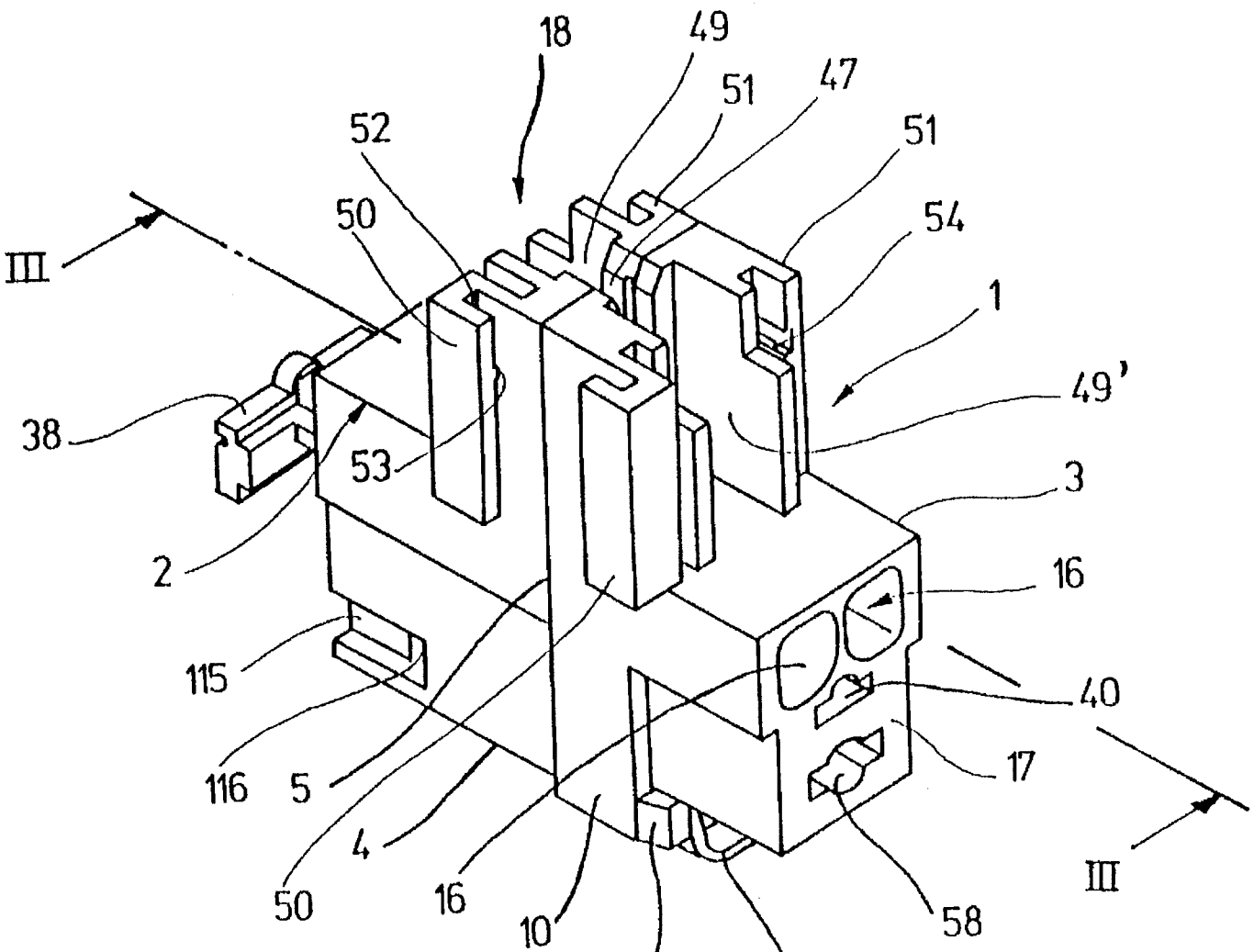
FIG. 1 is a perspective schematic view of a terminal or coupling connector according to the invention, in the form of a single unit for screwless connection of lines.
Figure 6:
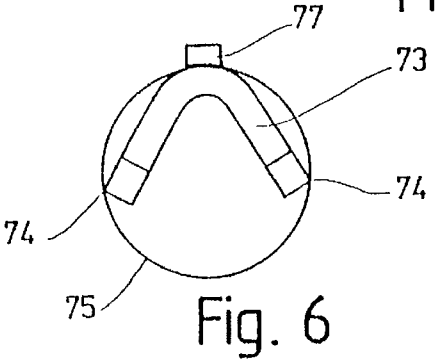
Figure 5:
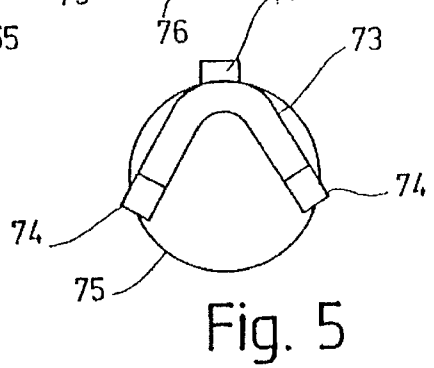
Figure 8:
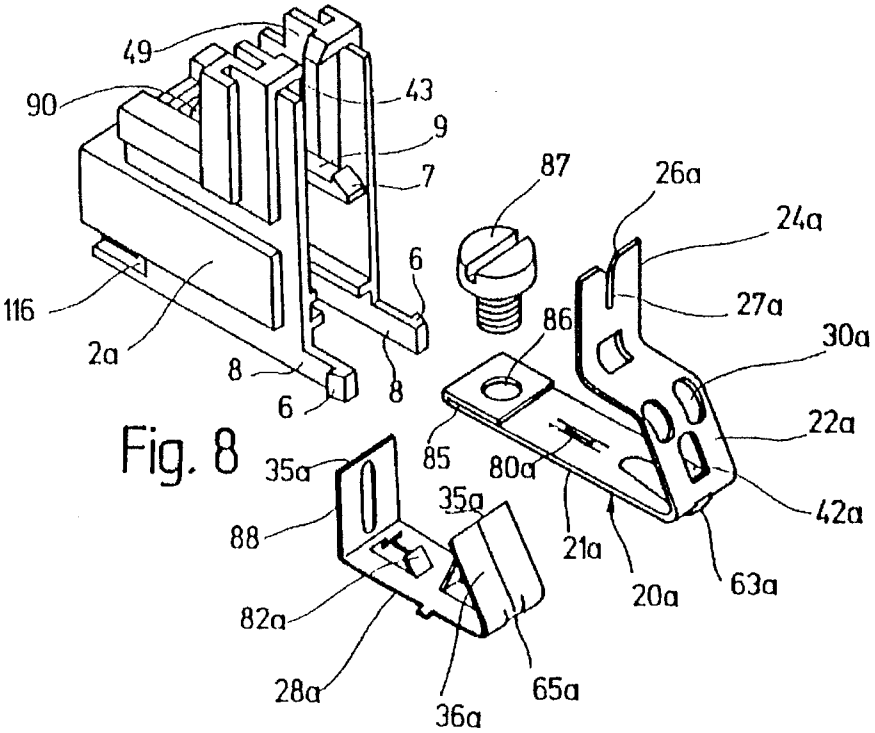
Figure 10:
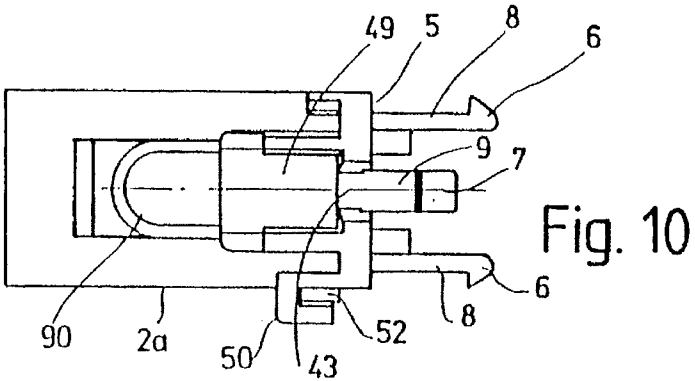
Figure 7:
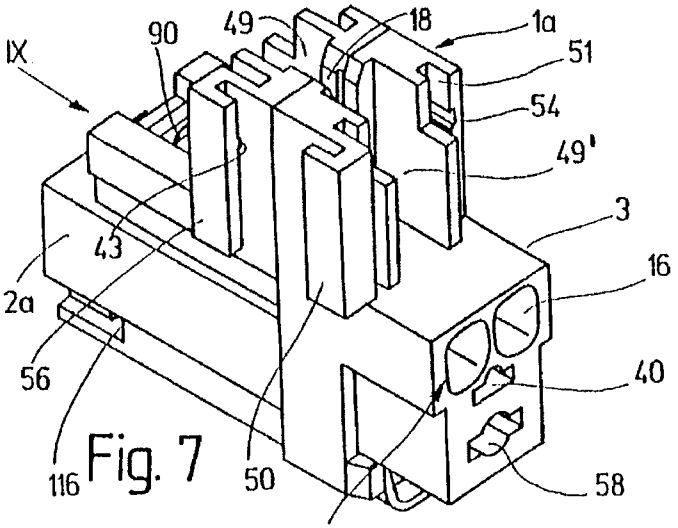
Figure 9:
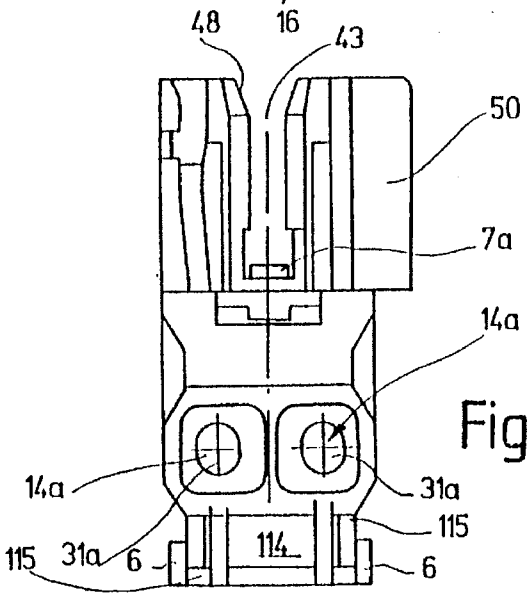
Figure 12:
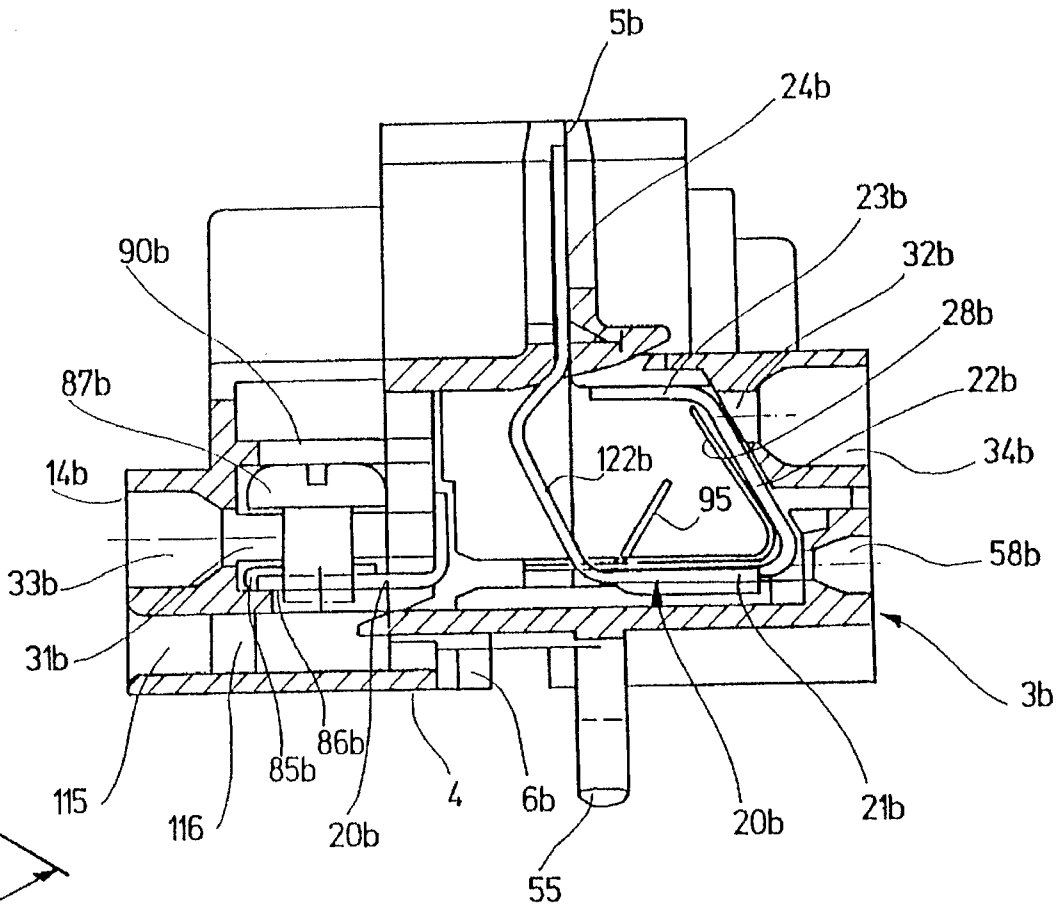
Figure 11:
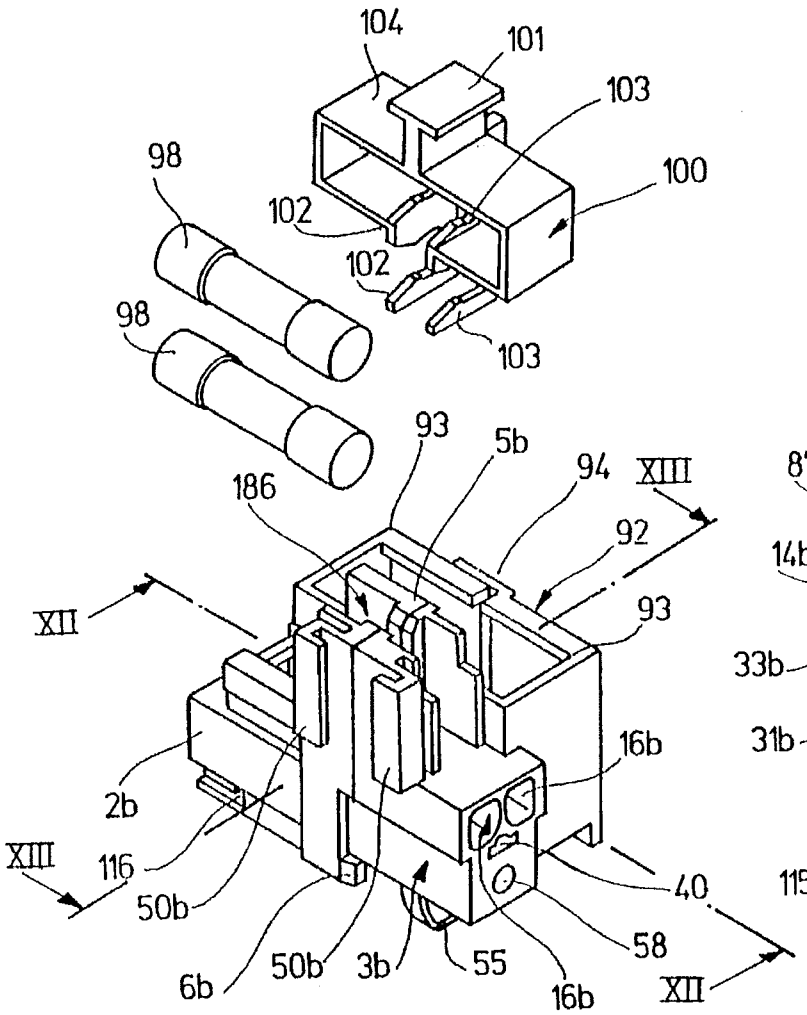
Figure 15:
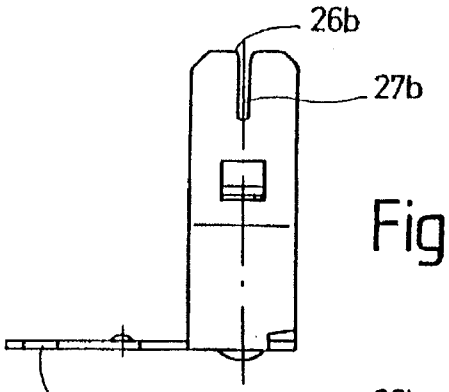
Figure 16:
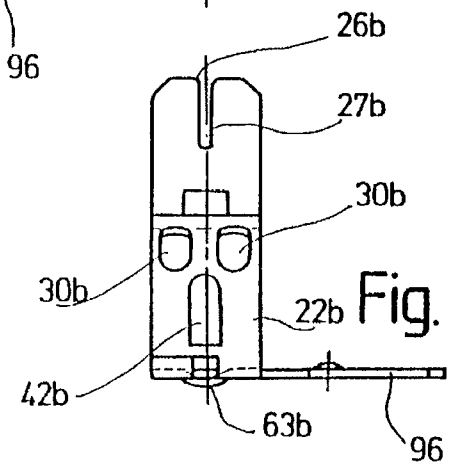
Figure 17:
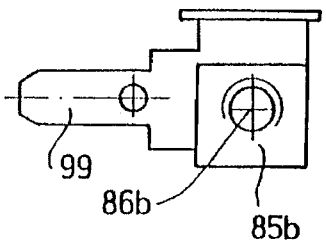
Figure 14:
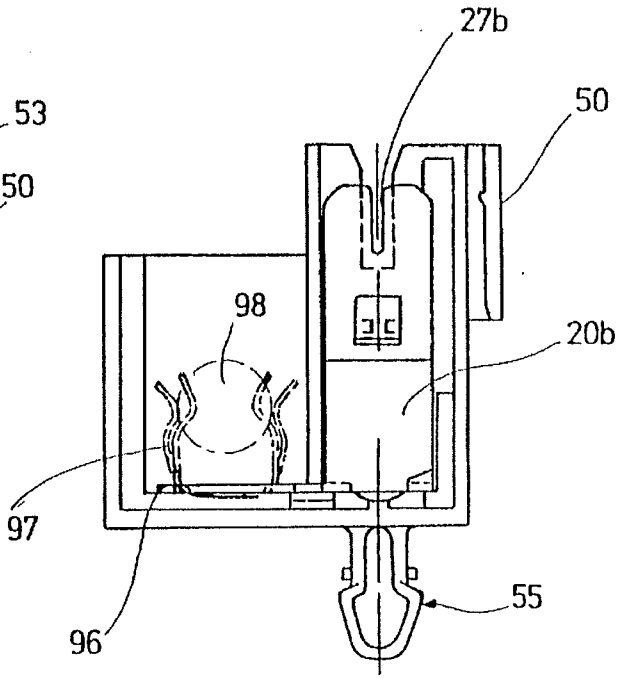
Figure 13:
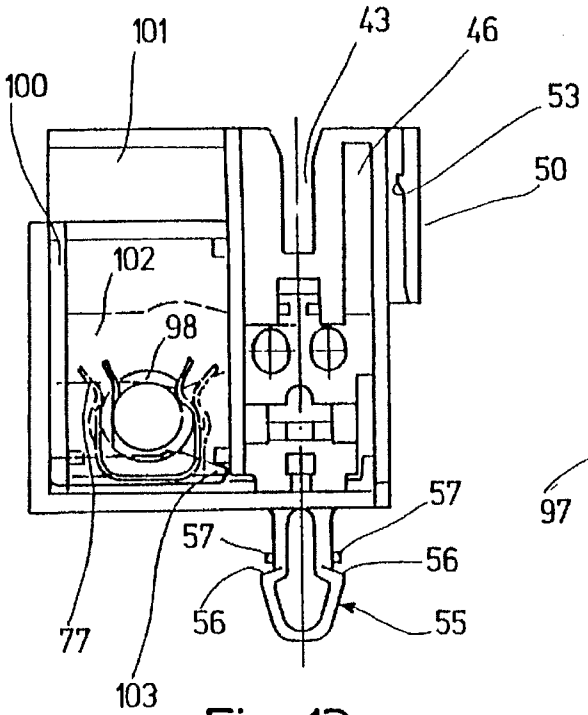
Figure 19:
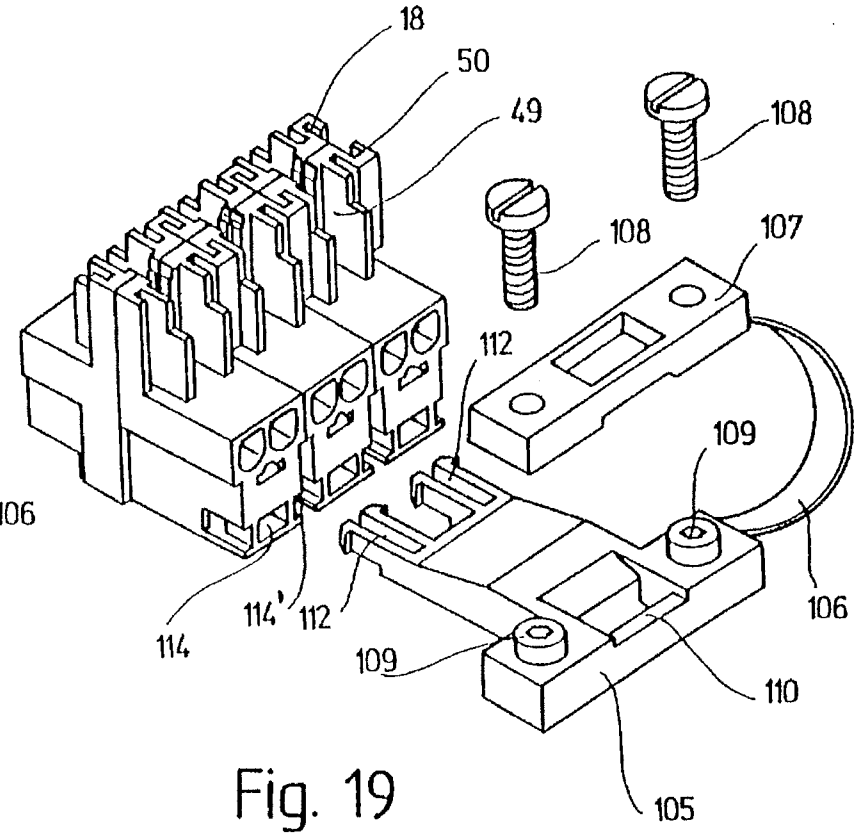
Figure 18:
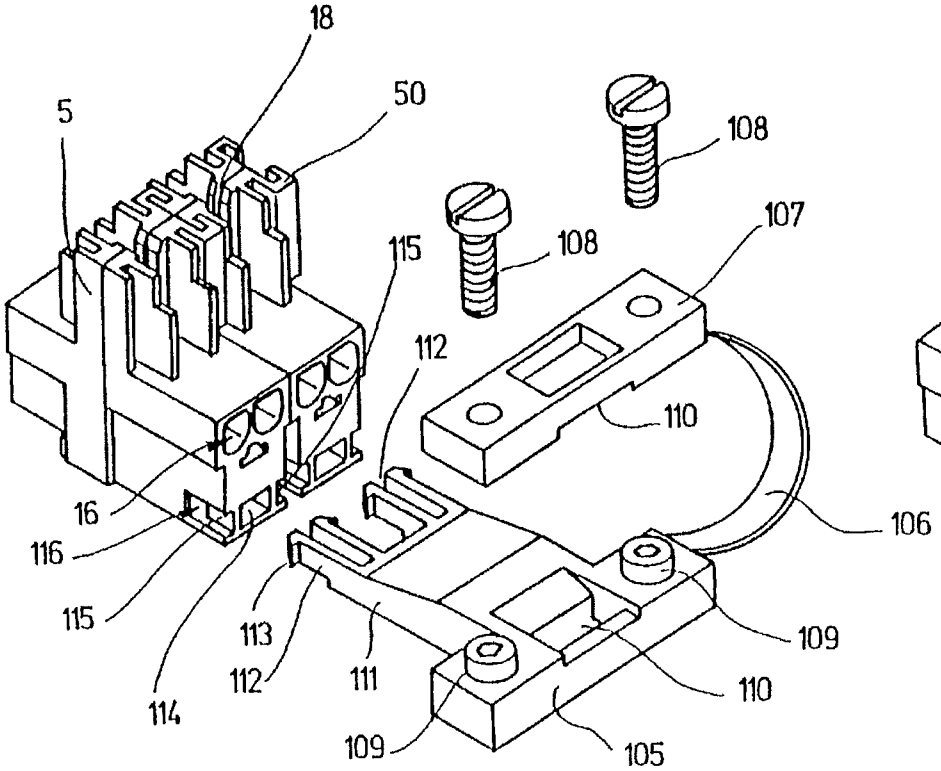

FIGS. 5 and 6, in a plan view from below, show the grounding clip of FIG. 2A of the terminal and coupling connector of FIG. 3 and in its association with a hole in the metal shim showing the non-snapped-in state (FIG. 5) and the snapped-in state (FIG. 6);

FIG. 7 is a perspective view of a terminal or coupling connector according to the invention in a second embodiment, with screwless connections and screw connections;

FIG. 8, in an exploded perspective view on a different scale, a partial housing of the terminal and coupling connector of FIG. 7, with the contact spring and the clamping spring;

FIG. 9 is a view from behind in the direction of the arrow IX of FIG. 7, on a different scale, of the terminal and coupling connector of FIG. 7;

FIG. 10 is a plan view on a different scale of the partial housing of FIG. 8;

FIG. 11, in an exploded perspective view, shows a terminal and coupling connector similar to FIG. 7 in a version with an associated fine-wire fuse, with the cap of the fine-wire fuse removed;

FIG. 12, in a side view on a different scale, shows the terminal and coupling connector of FIG. 11 in a section along the line XII—XII of FIG. 11;

FIG. 13, on a different scale and partly in section, shows the terminal and coupling connector of FIG. 11 in a section along the line XIII—XIII of FIG. 11, illustrating the front partial housing;

FIG. 14, in a corresponding view, shows the terminal and coupling connector of FIG. 13 with an inserted contact spring and with the cap of the fine-wire fuse removed;

FIGS. 15 and 16, in two side views from the front and from behind, show a contact spring of the terminal and coupling connector of FIG. 14;

FIG. 17 is a plan view of the second contact spring of the terminal and coupling connector of FIG. 14; and FIGS. 18 and 19, each in an exploded perspective view, show a connector device assembled from two and three terminal and coupling connectors of FIG. 1, respectively, with an associated strain relief for the conductors of the external wiring, illustrating two different possibilities for mounting the strain relief.

DETAILED DESCRIPTION

The terminal or coupling connector shown in a first embodiment in FIGS. 1–4 is designed in two parts.

The connector is specifically adapted for connection of live wires or, selectively, for use of grounding wires, in which the grounding wires can be connected to a grounding plate or chassis. If the wires connected by the connector are live wires, the grounding elements are merely omitted. The unit is highly versatile and meets all requirements: live wires as well as grounding wires, and permits connection of, for example, a supply wire to branch lines, in which the supply wire or one of the branch lines can be placed on the connector by an automatic wire insertion tool, for example.

The connector has a housing 1, made of insulating material and comprising two parts 2, 3, which are placed one against the other along a parting line 5 oriented at right angles to a bearing face 4. The two partial housings 2, 3 are interengaged with one another. To that end, as can be seen particularly from FIGS. 2–4, three hooklike interlocking or detent clamps 6, 7 are formed onto one partial housing 2; they protrude past the parting plane 5 and are seated on corresponding elastic arms 8, 9. The detent clamps 6 facing one another are located immediately adjacent to the bearing face 4, while the detent clamp 7 is provided approximately centrally in the partial housing 2, spaced apart from and above the detent clamps 6.

On the other partial housing 3, formed-on interlocking or detent elements 10 (FIG. 2) and 11 (FIG. 3) are assigned to the detent clamps 6, 7; with the partial housings 2, 3 put together in the way shown in FIGS. 1–4, the detent elements 10, 11 are engaged from behind. The detent elements 10 are in the form of striplike parts formed from outside onto the partial housing 3 on opposite sides, while the detent element 11 is formed by a crosswise rib located in the interior of the partial housing 3. As can be seen, the arrangement is made such that the two partial housings 2, 3 are inserted one into the other and locked in place in the horizontal direction, in terms of FIGS. 3, 4, or in other words parallel to the bearing face 4 and accordingly can be assembled to make the housing 1.

A plurality of spatially separated terminal connections for electric lines are provided on the housing 1. Two of these connections at a time are located side by side at 14 (FIG. 3) in the region of the rear face end 15 of the partial housing 2, and in alignment with them there are two further connections at 16 in the regions of the front face end 17 of the other partial housing 3, in such a way as to produce the same configuration on both of the broad face ends 15, 17. The connections at 14, 16 are each screwless connections, whose structure will be described in further detail hereinafter.

On top of the housing 1, a further connection 18 is provided, which is in the form of a slit-blade insulation piercing connector that is suitable for automatic wiring.

If the terminal connector is to be grounded, then a further connection, in the form of a plug contact connection, which is intended particularly for the connection of a grounding clip 200 (FIG. 4), can be used at 19 on the underside of the housing 1 in the region of the bearing face 4.

All of these connections 14, 16, 18 and 19 are assigned electrical contact means that are formed of an electrically highly conductive material, such as electrical contact bronze or brass, and thus are electrically conductively connected to one another, on a common contact spring 20 (FIG. 2) located in the interior of the housing 1.

The contact spring 20 (FIG. 2) specifically comprises a thin strip of sheet metal bent essentially to form a closed trapezoid, which has one straight lower leg 21, two lateral legs 22 inclined inward obliquely from it, and one upper leg 23 in two parts that is approximately parallel to the lower leg. Of the two parts of the upper leg 23, one, in the form of a tab 24, is bent upward at a right angle approximately in the middle of the length of the lower leg 21, while the other part at 25 is likewise bent approximately at right angles downward and ends with its end edge in the vicinity of the lower leg 21. An open-edged insulation piercing slit 27, provided with insertion bevels 26, is formed in the tab 24, beginning at the upper end edge thereof, and forms the contact means for the SBIP connection 18.

A clamping spring 28 (FIG. 2) of resilient sheet steel, bent substantially into a C and adapted to the internal contour of the contact spring 20, is inserted into the contact spring 20; it is retained by the bent part 25 of the contact spring 20 and serves the purpose of fixation of the electrical lines connected to the contact spring 20.

To receive the blank ends, that is, the insulation-stripped ends of the lines that are to be connected, certain openings are provided in the lateral legs 22 of the contact spring 20; of these openings, those associated with the connections 14 in the partial housing 2 are in the form of recesses 29 open toward the side, and those associated with the other connections 16 in the partial housing 3 are in the form of oval holes 30. The recesses 29 and holes 30 are each aligned with the respective line insertion conduits 31 and 32 (FIGS. 3, 4) provided at the connections 14 and 16 in the partial housings 2 and 3; these conduits widen toward the outside at 33 and 34, respectively, into a form of cylindrical segment of greater diameter, which serves to receive the nonstripped part of the line in such a way as to assure the necessary touch protection from the outside at these connections.

The recesses 29 and the openings 30 are covered by the lateral legs 36 of the clamping spring 28, which end with their upper sharp edges 35 in the vicinity of the upper edge of the recess or opening. When an electric line to be connected is inserted, they bend elastically inward, with the consequence that they press the end of the line with their edges 35 against the applicable part of the upper leg 23 of the contact spring 20, and in so doing simultaneously spread toward the end of the line and lock the line in a strain-protected manner.

Figure 2:
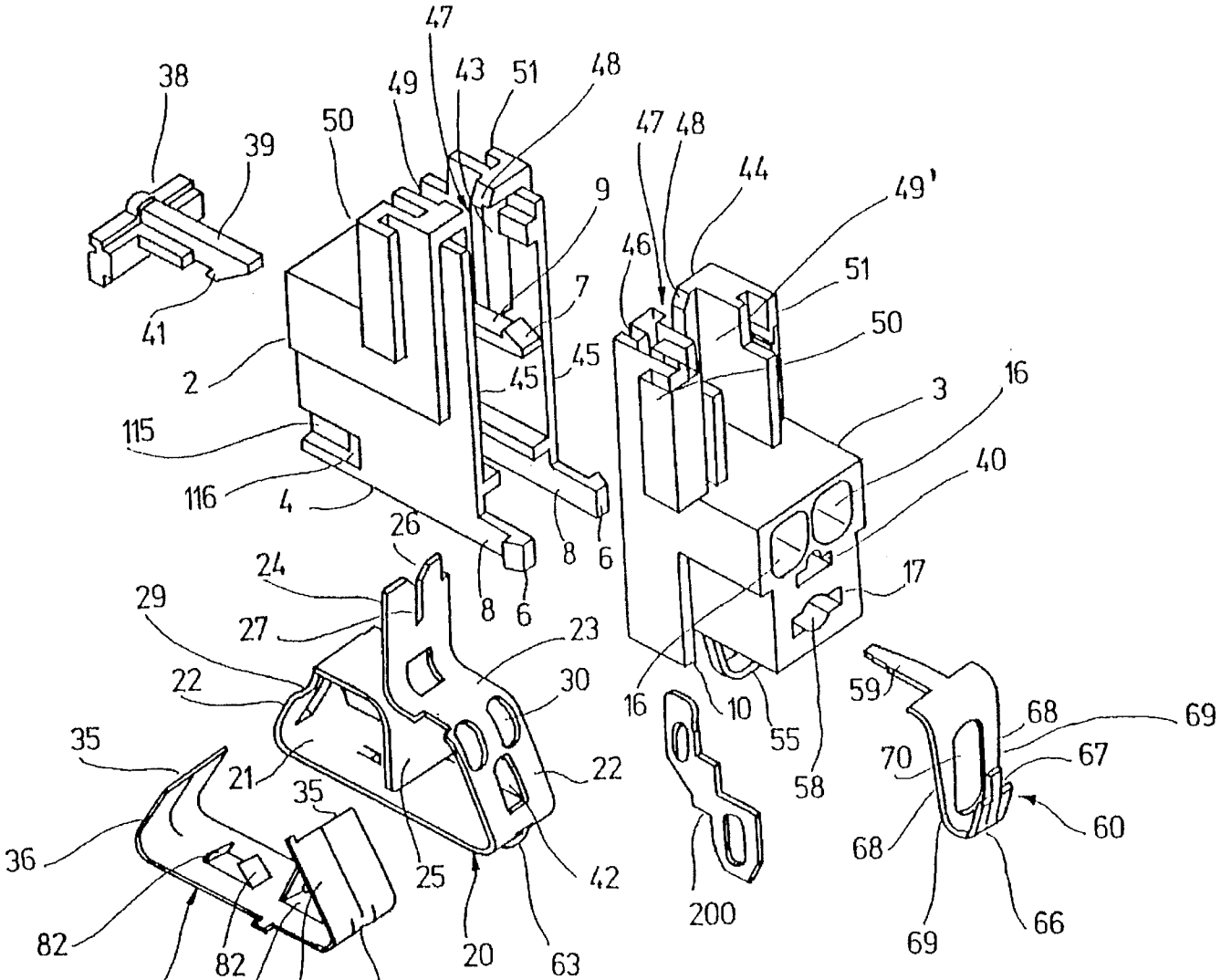
FIG. 2 is a perspective exploded view of the terminal or coupling connector of FIG. 1 with a grounding clip.
Figure 3:
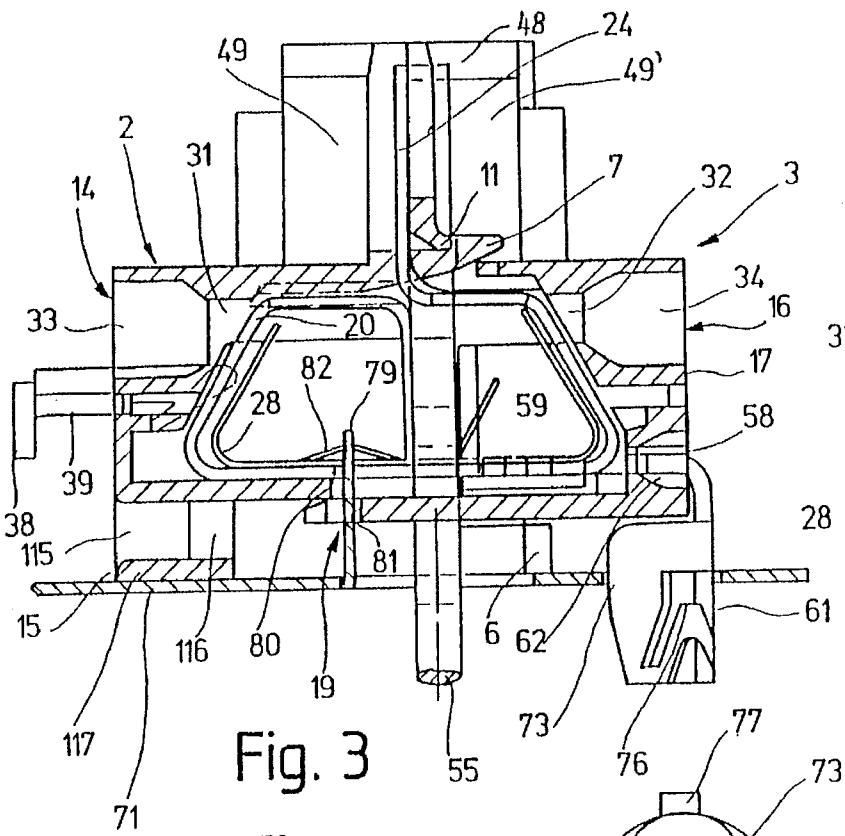
FIG. 3 is a side view, on a different scale of the terminal or coupling connector of FIG. 1, in section along the line III—III of FIG. 1.
Figure 2A:
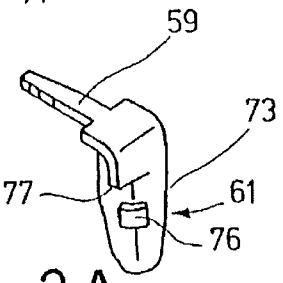
FIG. 2A illustrates an alternate grounding clip.

To enable disconnecting a previously connected line end, a disconnector key 38 is provided in each of the partial housings 2, 3; one such key is shown in FIGS. 2, 3, and its actuation makes it possible to disconnect the line contact simultaneously at both connections 14 and 16.

The substantially T-shaped disconnector key 38 is supported displaceably, with a shaft 39 of rectangular cross section, in a longitudinal guide 40 located below the connections 14 and 16, beginning at the face end 14 and 17, and oriented parallel to the line insertion conduits 31 and 32. The shaft 39 is provided on its end with a hook part 41, which after the insertion through the conduitlike longitudinal guide 40 (FIG. 7) catches on the inner edge of this guide, so that the disconnector key 38 is supported in captive fashion on the applicable partial housing 2 or 3.

As can be seen particularly from FIG. 2, the disconnector key 38 (only one of which is clearly visible) protrudes by the front end of its shaft 39 through an opening 42 in the lateral leg 22, oriented toward it, of the contact spring 20. Upon actuation of the disconnector key 38, the leg 36 of the clamping spring 28 is accordingly pressed inward via the shaft 39 of this key, and as a consequence the edge 35 releases the connected conductor, which can then be pulled out of the connector.

Because the disconnector key 38 is located under each connection 14 or 16 on the respective face end 15 or 16 of the housing 1, the result is great economy of space and also ease of operation.

The SBIP connection 18 on the top of the lower part 1 of the housing of substantially rectangular cross section is formed jointly by suitably formed-on elements of both partial housings 2, 3. The tab 24 of the contact spring 20 that carries the insulation piercing slit 27 is located essentially precisely in the parting face 5. On the broad side, it is supported by one bearing face each 43 and 44 on the partial housings 2 and 3, respectively, and on the narrow side is retained between two striplike housing parts 45, formed onto the partial housing 2, which when the housing is put together engage corresponding groovelike recesses 46 (FIG. 2) on the other partial housing 3. In the region of the two bearing faces 43, there is one continuous insertion slit 47, aligned with the insulation piercing slit 27; it is provided with insertion bevels 48 for the conductors to be connected, and its width is somewhat greater than the width of the insulating-piercing slit 27.

The insertion slit 47, whose wall as can be seen from FIG. 2 is assigned half to each of the two partial housings 2, 3, is adjoined on each of the two partial housings 2, 3 by one axially parallel groovelike indentation 49, 49', bounded by,parallel sides and aligned symmetrically with the insertion slit 47, the width slit 47. The dimensions of the groovelike indentations 49 and 49' the insertion slit 47 of the line connected to the connection 18 is protected against touch in the associated groovelike indentation. Specifically, this means that the free part of the end of the line must not be reached by the standardized test finger in the region of the groovelike indentations 49 and 49'. At the same time, the two groovelike indentations serve to guide the line laying tool in automatic wiring, as explained in detail in U.S. patent application Ser. No. 08/190,129 mentioned above, to whose disclosure reference is hereby expressly made.

Laterally of the groovelike indentation 49, 49', an essentially U-shaped coupling part 50 is formed on one side and a complementary striplike coupling part 51 on the opposite side, of each of the two partial housings 2, 3.

As can be seen from FIG. 1, the two U-shaped coupling parts 50 in the assembled state enclose a T-shaped groove 52, which is oriented symmetrically to the parting face 5, extending at right angles to the bearing face 4, with its bottom face adjoins the flat side of the two partial housings 2, 3.

The interengaging or coupling parts 50, 51 form complementary devices for interengaged coupling of the single connector units shown in FIG. 1, which can be lined up in an arbitrary combination with one another in the manner seen in FIGS. 18, 19. In the region of the T-shaped groove 52, when the single units have been assembled, detent protrusions 53 provided on the inside of each engage corresponding detent grooves 54 on the inside of the coupling parts 51 of the adjacent single unit, thus providing secure locking of the coupling.

Since each of the coupling parts 50 extends over only less than half the height of the partial housings 2, 3, the process of coupling two single units becomes especially simple: One single unit is simply placed from below with its coupling parts 51 against the coupling parts 50 of the other single unit and is then pushed upward until the detent protrusions 53 engage the detent grooves 54. In this position, the tops of the single units are aligned with one another, resulting in a uniform, dimensionally stable structural unit in the form of a multi-pole connector. In the region of the bearing face 4, fastening means in the form of a so-called fastening or attachment key 55 (FIGS. 1, 2) is formed onto the bottom of the partial housing 3; its form can be seen particularly from FIGS. 13, 14. The attachment key 55 is in essentially eyelet form, with two bearing shoulders 56 and two detent protrusions 57. It is pressed by its conically tapering end into a corresponding hole of a metal fastening sheet or the like and elastically deformed, until the edge of the hole has passed the shoulders 56, whereupon a secure interlocking engagement is assured.

Since the attachment key 55 is formed onto the partial housing 3 and extends through, between the two detent clamps 6 of the other partial housing 2, it assures at the same time the unseparability of the detent connection between the two partial housings 2, 3 once the connector is installed. Moreover, it keeps captive a further single unit that may be lined up via the coupling parts 50 captive, doing so because this single unit is locked, with its top between the lower edge of the coupling parts, as well as the chassis, fitting over it.

Figure 4:
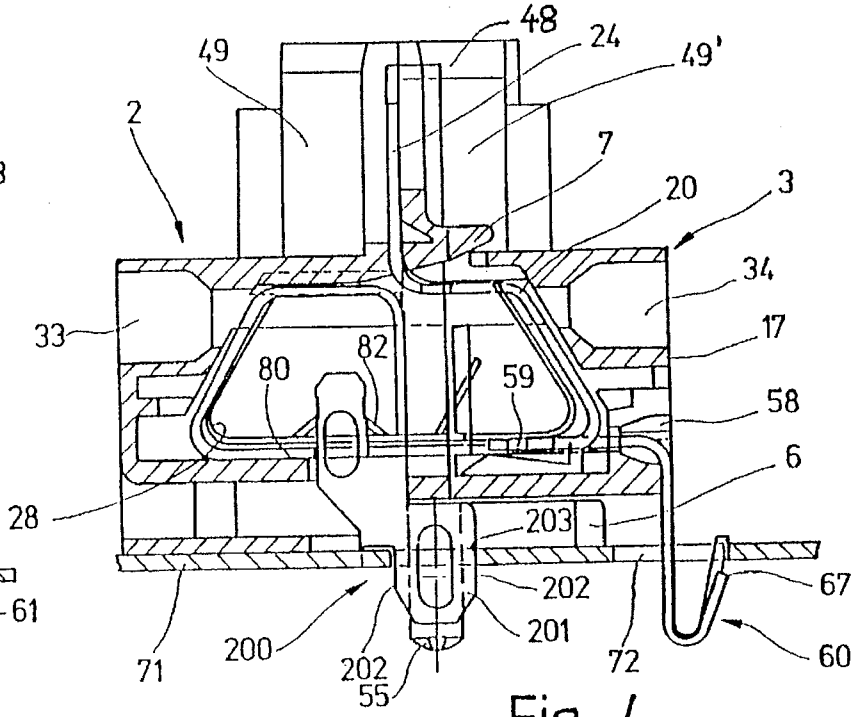
FIG. 4 is a corresponding sectional view of the terminal or coupling connector of FIG. 3 with a grounding clip inserted.

A further terminal 58 is provided below the longitudinal guide 40, at least on the face end 17 of the partial housing 13. It is intended to receive a flat plug part 59 of a grounding clip 60 or 61 (FIGS. 2, 2A). FIGS. 3, 4 show that the connection 58 forms an insertion conduit 62 which extends inward to the contact spring 20, leading to a slitlike plug receptacle 63, punched out from the contact spring 20 in the region of the lower leg 21 thereof (see FIG. 2).

In the region of the plug receptacle 63, the clamping spring 28 is recessed at 64, and it is provided at 65 with a small locking tab 65 cut away by making lateral parallel notches; the tab has a sharp free edge and fixes the plug part 59 of the grounding clip 60 or 61, introduced through the connection 58, in such a way that it cannot be pulled out again.

The two grounding clips 60, 61 can be used selectively, and indeed quite generally the connection 58 can be used as a protective conductor connection.

The grounding clip 60, adjacent to the plug part, has a striplike shaped sheet-metal part, bent essentially at right angles, which on its end at 66 (FIGS. 2, 4) is bent upward, and at the bent end, two parallel longitudinal slits form three contact and locking prongs 67, of which the middle prong should be bent somewhat inward relative to the two shorter, outer prongs. Laterally on the shaped sheet-metal part, two shoulders 68 located at the same height are cut, and adjacent to them at 69, lateral sharp edges are formed on the outside of the elastically deformable legs defined by an oval opening 70.

The dimensions of the shaped sheet-metal part are chosen such that it is inserted into a cylindrical hole 72 provided in a sheet-metal shim 71 (FIG. 4) and can be locked in this hole via the contact and locking prongs 67, as shown in detail in FIG. 4. The mutual spacing of the sharp edges 69 relative to the hole diameter is chosen such that when the grounding clip 60 is thrust into the hole 72, the edges 69 scratch the edge of the hole or cut into it somewhat, so that any residues of paint or contamination there are removed and perfect electrical contact is established.

The other grounding clip 61 functions fundamentally similarly; adjacent to the plug contact 59, it has a shaped part 73 (FIG. 2A) likewise bent downward at a right angle, but this part is bent in approximately a V about a vertical axis, as FIGS. 5, 6 show. The shaped part 73 is sharp-edged at 74 in the region of its opposed long edges; on its end, it is slightly conical, to facilitate the insertion of the metal shim 71 into the hole suggested at 75.

Upon insertion into this hole 75, the two legs of the V-shaped part 73 are pressed elastically inward, and their sharp edges 74 scratch or cut into the boundary of the hole along it and thus remove any residues of paint or contamination and again establish a good contact. At the same time, a three-point contact with the boundary of the hole is brought about.

A detent 76 cut into the shaped part 73 in the region of the bending line, together with the shoulder 77 cut opposite it, effects a perfect positive locking of the engaged grounding clip 61 in the hole 75.

At the grounding connection 19 provided on the underside of the partial housing 2, a tab, bent upward from the metallic attachment sheet, or chassis, as shown in dashed lines at 79 in FIG. 3, or a clip 200 can be connected. To that end, the contact spring 20 is provided in the region of its lower leg 21 with a corresponding slitlike opening 80, which is aligned with an insertion conduit 81 in the housing 1 and leads to two laterally cut-apart partially deployed locking tabs 82 in the clamping spring 28. The locking tabs 82, oriented obliquely toward one another, are bent elastically open and spread apart, in the manner visible from FIGS. 3, 4, when the grounding tab 79 or the grounding clip 200 is inserted.

While in the embodiment of FIG. 3 the connection 19 is located laterally beside the attachment key 55 in such a way that the grounding tab 79 can be introduced easily, in the embodiment of FIG. 4 the grounding clip 200 is bent in such a way that its plug part 201 has its part protruding past the bearing face 4 located inside the attachment key 55, beyond which it protrudes on both sides. The plug part 201 is in turn formed on opposite sides with sharp long edges 202, similarly to the case with the grounding clip 60; upon insertion into the hole 203 of the attachment sheet 71, 71', this clip scratches or cuts into the boundary of the sheet so as to establish a perfect contact.

The single unit, described above in conjunction with FIGS. 1–4, of a single-pole or single-wire terminal and coupling connector is formed with screwless connections on its two face ends for conductor connection, except for the SBIP connection 18. In particular, it is intended for the internal wiring of apparatuses, such as lights.

In certain countries, there is a demand for instance to connect lights to the lines of interior building wiring via screw connections. To make this possible, the single unit of FIGS. 1–4 is modified as shown in FIGS. 7–10:

The first partial housing 2 is replaced with a partial housing 2*a*, which is identical in its external dimensions and in the region of its insulation piercing connection 18 and the coupling elements 50, 51, to the partial housing 2 of FIGS. 1–4. It can therefore be put together with the second partial housing 3 of FIGS. 1 and 4 and locked in the same way, resulting in the single connector unit shown in FIG. 7, whose complete housing is marked 1*a*.

In the complete housing la, a modified contact spring 20*a*, which essentially forms one "half" of the contact spring 20, is provided as a contact means. The lower leg 21*a*, which has the impressed plug receptacle 63*a* and the opening 80*a* for the tab 79 (FIG. 3) or for the grounding clip 200 (FIG. 4) is adjoined on the side of the partial housing 3 by the inwardly inclined lateral leg 22*a* having the openings 30*a* and 42*a*, whose significance has already been explained. The leg 22*a* continues in the form of the approximately perpendicularly upward-bent tab 24*a*, which in turn has the insulation piercing slit 27*a* with the insertion bevels 26*a*.

On its other end, the lower leg 21*a* is folded over 180° at 85 and provided with a threaded hole 86, into which a clamping screw 87 can be screwed.

A clamping spring 28*a* is inserted into the contact spring; in its essential parts, it is formed similarly to the clamping spring 28 of FIG. 2. Identical parts are provided with the same reference numerals, followed merely by the lower-case letter a. On its end opposite the inward-inclined leg 36*a*, the clamping spring 28*a* is bent upward at a right angle at 88 and supported in the axial direction in the partial housing 2*a*.

As seen from FIGS. 7 and 10, the partial housing 2*a*, adjacent to the parts that form the groovelike indentation 49 of the SBIP connection 18, is provided on its top with a semi-oval continuous opening 90, through which the clamping screw 87 is accessible from above when the partial housings 2*a*, 3 have been put together. The situation in three dimensions is fundamentally as shown in the sectional view of FIG. 12.

The line insertion conduits 31*a* toward the rear lead on both sides to the clamping screw 87, by means of which they can be clamped, via an interposed shim, against the end part 85 of the contact spring 20*a*.

Since the contact spring 20*a* and the clamping spring 28*a*, on their side located in the partial housing 2, are formed identically to the corresponding part of the clamping spring 20 of FIG. 2, it is possible for the "normal" other partial housing 3 already described to be connected to the partial housing 2*a* that has two screw connections 14*a*, resulting overall in again a single unit, which has a pair of screw connections 14*a* and a pair of screwless connections 16. These latter connections can again be assigned a disconnector key 38, whose longitudinal guide can be seen at 40 in FIG. 7, while the other parts are identical to those of FIG. 2 and are therefore provided with the same reference numerals and not described again here.

Since the coupling elements 50, 57 are identical to those in the embodiment of FIGS. 1–4, single units of FIG. 7 can be combined in an arbitrary order with single units of FIG. 1 to make a multi-pole connector and locked together, lined up, to form a structural unit.

In closing, it should also be noted that in general in the partial housing 2*a* in FIGS. 7–10, parts that are identical to corresponding parts of the partial housing 2 of FIG. 2 are provided with the same reference numerals with the addition of the letter a and are not described again here.

In principle it is also possible to construct a single unit of this kind in such a way that the partial housing 3, similarly to the partial housing 2*a*, is also equipped with two screw connections, and it is also possible, depending on the intended use, to leave the partial housing 2 in a condition for two screwless connections, as in FIG. 2, and to arrange only the partial housing 3 for two screw connections at 16.

In either case, all that is needed is to form the corresponding partial housing 2 and/or 3 accordingly and to provide a contact spring of suitable function and having an associated clamping spring. Regardless of the design of the line connections 14 and 16, all these single units have an identically designed SBIP connection 18, located at the same point, which is suitable for automatic wiring. The single units are also provided with identical coupling means 50 and/or 51, which make it possible to combine the single units with single units of the same or different function, and lock them together, to make multi-pole connection devices.

While in the above description, two exemplary embodiment of terminal and coupling connectors with different forms of connections have been explained, there are also instances of applications in which there is a demand for devices, immediately on the connector unit, that can hold an electrical operating means, such as a capacitor or a fine-wire fuse. One example of such an application is shown in FIGS. 11–17. The exemplary embodiment illustrated is formed with the fine-wire fuse and otherwise is arranged so that once again it can be coupled positively on one side to single units of FIGS. 1, 7.

In its basic design, the single unit of FIGS. 11–14 is equivalent to the single unit of FIGS. 7–10. Identical elements are therefore again provided with the same reference numerals, merely with the addition of a lower-case b, so that no further description for parts of identical function is necessary.

On the side opposite the coupling elements 50*b*, a fuse housing 92, designed fundamentally like a box of rectangular cross section, is formed onto the two partial housings 2*b* and 3*b*, of which the partial housing 2*b* has two connections 14*b* embodied as screw connections and the other partial housing 3*b* is provided with two connections 16*b* in the form of screwless connections. The fuse housing 92 is in two parts. It comprises two housing parts 93, each U-shaped, which are joined to the partial housings 2*b* and 3*b*, respectively, and which overlap at 94 in the parting plane 5*b* between the two partial housings 2*b*, 3*b*. The SBIP connection located on the top of the partial housings 2*b*, 3*b*, at the connection 18*b* is formed identically to the connection 18 (FIG. 1) or 18*a* (FIG. 7) and will therefore not be described in detail again.

In the two partial housings 2*b*, 3*b*, two separate contact springs 20*b* and 20*b'* are accommodated, of which the contact spring 20*b* is formed similarly to the right-hand side of the contact spring 20 of FIG. 2. Its lower leg 21*b* is adjoined by the inward-inclined l , and in which the openings 30*b* (FIG. 16) are also provided, while the plug receptacle 63*b* is impressed in the region of the lower leg 21*b*. Reference numeral 23*b* indicates the upper leg, which extends to approximately the vicinity of the parting plane 5*b*.

On the other side, the lower leg 21*b* continues in the form of a second lateral leg 122*b*, which is oriented approximately parallel to the first lateral leg 22*b*, making the contact spring 20*b* approximately diamond-shaped. This second lateral leg 122*b* on the left in FIG. 2 then continues in the form of the vertical tab 24*b*, which has the insulation piercing slit 27*b* with the insertion bevels 26*b*, as FIGS. 15, 16 show.

The connection condition in the region of the connections 16*b*, formed as a screwless connection, in the partial housing 3*b* are the same as in FIG. 2 and require no further description.

A clamping spring 28*b*, whose basic design can be seen from FIG. 12, is inserted into the contact spring 20*b*. The clamping spring 28*b* is approximately triangular, with a tab 95 cut away and bent upward in its lower leg.

Beginning at a right angle laterally from the lower leg 21*b*, the contact spring 20*b* is provided with a connecting tab 96 (FIGS. 15, 16), which in the manner illustrated by FIG. 14 protrudes into the fuse housing 92, in which it is electrically conductively connected to a substantially U-shaped, resilient fuse retainer clamp 97 slipped into it. The fuse retainer clamp 97 serves to receive a fine-wire fuse, suggested at 98, in the known manner.

Spaced apart from the fine-wire fuse 98 of the fuse holder of FIG. 14, a second such fuse retainer clamp 97 is located on the bottom of the fuse housing structure 93; it is electrically conductively connected to a connecting tab 99 (FIG. 17) of the other contact spring 20*b'* (FIG. 12), in a manner corresponding to FIG. 14.

The contact spring 20*b*, accommodated in the partial housing 2*b* in a manner electrically insulated from the contact spring 20*b*, is bent substantially in an L (FIG. 12) and is formed with double walls at 85*b* by means of a folded-in part and provided with the threaded hole 86*b*. The clamping screw 87*b* screwed into the threaded hole 86*b* is shown in FIG. 12 and is accessible from outside (from above) via the housing opening 90*b*.

For inserting a fine-wire fuse 98 into the two fuse retainer clamps 97, a boxlike cap part shown at 100 in FIG. 11 is used; it has a handle 101 and two formed-on clamping arms 102, 103 located in pairs vertically one above the other.

Between the pairs of clamping arms 102, 103, the fine-wire fuse 95 is clamped resiliently; a replacement fuse can be accommodated in the space between the upper clamping arms 102, 103 and the wall 104 of the boxlike cap part. The cap part 100 is then thrust from above into the fuse housing 92, until the fine-wire fuse 95, retained between the pairs of arms 102, 103, is clamped between the retainer clamps 97.

For the single unit of FIG. 1 equipped with a fine-wire fuse as well it is true that intrinsically it may be designed with screwless connections on both sides, or with screw connections on the right-hand side instead of on the left-hand side (FIG. 12), as well as with two screw connections.

Alternatively it would also be possible for the fuse housing 92 not to be formed onto the partial housings 2*b*, 3*b* but rather to be made as a separate part, which for example can be coupled by means of laterally formed-on coupling parts 50 or 51 as in FIG. 2 to the single unit of FIG. 1 or 7; in these single units care need merely then be taken to accommodate the contact springs 20*b* and 20*b'* of FIG. 12 and 20*a* of FIG. 8 and to provide a corresponding second contact spring insulated from them, such that in fact both contact springs have devices with which they can be electrically conductively connected to fuse holding clamps 97 on the bottom of the fuse housing 92.

The single units of different function, three of which are shown in FIGS. 1, 7, 11, and which are described above in conjunction with the exemplary embodiments described, may as already noted be put together with single units of the same or different function in an arbitrary order to make connection devices and locked to one another positively via the identical coupling elements 50, 51, as shown in FIGS. 18 and 19 in the form of examples for a two-pole and a three-pole terminal and coupling connector. Since the single units have attachment keys 55 on their underside, the thus-assembled structural unit can be locked in a simple way in associated fastening holes on the bottom of a housing or the like.

The invention therefore also includes a modular set, in which such single units of the same and different function are included and which enables the user, with a small number of different single parts, to put together various single units and from them various connection devices, to meet his own particular needs. The connection devices thus put together, for instance in the form of a multi-pole connector or a connector strip, may also be assigned additional devices that are advantageous for the use of these connector devices and that are joined to it in such a way that they do not require any changes in the single units themselves.

This is illustrated in FIGS. 18, 19 in connection with a strain relief for lines to be connected, particularly for an external wiring.

The strain relief has a flat, essentially T-shaped base part 105, which is made of insulating material, and on which a line clamping bar 107 is retained captive via a film hinge 107; by means of two clamping screws 108, with which threaded bushes 109 in the crosswise legs of the base part 105 are associated, the bar 107 can be screwed to the base part 105. Clamping ribs 110, which are indented and provided on the base part 105 and the clamping bar 107, in the usual way assure the positionally correct, strainproof fixation of the electric line clamped between them with elastic deformation of the line insulation.

On the end of the long leg 111 opposite the crosswise leg of the base part 105, pairs of detent prongs 112 facing one another are provided, each of which has a detent hook 113 pointing outward.

For coupling the strain relief to the single units of FIGS. 1, 7 and 11, the partial housings 2, 2*a*, 2*b* of them are each provided, beginning at the face ends 14, 14*a*, 14*b*, respectively, with connection channels 114 of rectangular cross section and bounded by parallel sides; these channels extend over a portion of the length of the partial housing 2, 2*a*, 2*b* and are laterally bounded by two parallel ribs 115, which are recessed inward relative to the adjacent side face of the respective partial housing. The ribs 115 are each bounded, on their side toward the parting face 5, by a rectangular detent opening 116 passing through the side wall and open toward the outside; the precise dimensions of this opening can be seen from FIG. 3. In addition, the connection channels 114, defined on the underside by a formed-on rib part 117 (FIG. 3), behind the detent opening 116 open out on the underside of the partial housing 2 (2*a*, 2*b*) in the region between the detent arms 8, as can likewise be seen from FIG. 3.

The cross-sectional dimensions of the connection channels 114 are chosen such that each connection channel 114, in the manner visible from FIG. 18, is arranged to receive one pair of detent prongs 112, whose detent hooks, in the inserted state, interlock in the detent opening 116 and thus fix the shaped part 105 of the strain relief in a positionally fixed manner.

As FIG. 18 shows, the lateral spacing of the pairs of detent prongs 112 on the base part 105 is adapted to the modular dimension of the single units or in other words of their partial housings 2, so that in a two-pole connection device, the shaped part 105 can be inserted by its detent prongs 112 into the connection channels 114 of adjacent single units. The strain relief is thus oriented, with the cable clamped in place between the ribs 110, toward the middle between the two single units, that is, their pairs 14 of connections.

The ribs 115 are recessed relative to the adjacent side walls of the partial housings 2 (2*a*, 2*b*) by such an amount that once again one insertion channel 114' is defined between two single units coupled positively to one another via the coupling elements 50, 51; this channel 114', open at the bottom, has the same cross-sectional dimensions as the connection channel 114 of a single unit. Since the modular dimension of the connection channels 114' of single units lined up with one another is the same as that of the connection channels 114, the base part 105 of the strain relief can accordingly, as may be learned from FIG. 19, be inserted selectively into two adjacent connection channels 114' as well and locked in the detent openings 116 thereof. In the three-pole connection device shown, this means that the connection cable firmly clamped in the strain relief via the ribs 110 is now oriented toward the connections 14 of the middle single unit.

If there is a greater number of single units lined up in the manner described, more than one strain relief means may also be provided, in such a way that shaped parts 105 are joined together, for instance with their crosswise legs abutting as well.

The provision of the strain relief in the manner described is independent of the form of the connections 14, 16 of the single units and hence independent of their function as well. In principle, embodiments are also possible in which the connection channels 114 are provided in the manner described with the ribs 115 on both partial housings 2, 3 (2*a*, 2*b*; 3*a*, 3*b*), or in which only the other partial housings 3 (3*a*, 3*b*) are provided with such connection channels or conduits.

One advantage of the strain relief described is that it can be inserted retroactively even after the installation of the connection, for instance in a light, without having to disconnect the fastening of the connection device. Since the strain relief has a base part 105 inserted at the face end, short and simple line courses for the lines leading from the firmly clamped cable into the connections are also achieved.

By the separation as illustrated of the vertically split housing 1 into two partial housings 2, 3 (FIGS. 1–4), very simple injection molded parts can be used for the partial housings, which are predominantly made with slideless injection molding tools. This means that only a small number of different injection molding tools needs to be kept on hand, and lower investment costs are involved despite a large number of possible variants of the connectors.

We claim:

1. Electrical terminal and coupling connector having at least two spatially separated terminal connections adapted for connection to external electrical conductors;

contact elements associated with each one of the connections, said contact elements being electrically interconnected interiorly of said coupling connector, wherein, in accordance with the invention, the connector comprises at least two parts (2, 3; 2*a*, 3*a*, 2*b*, 3*b*), each one of said parts having at least one of the terminal connections (14, 16; 14*a*, 16*a*; 14*b*, 16*b*);

said parts including interengaging interlocking means (6, 7, 8; 10, 11), locking said parts together into a single unit and thereby forming said connector;

at least one of said terminal connections comprising a slit-blade insulation piercing connector (SBIP) (18);

wherein said connector includes interengaging locking means (50, 51) for interengaging locking connection with another connector, wherein said other connector has complementary interengaging locking means;

wherein said single unit comprises a two-part housing 1*a*; 1*b*), the parts of said housing being joined together at a parting face (5); and wherein at least one contact spring (20; 20*a*; 20*b*), forming one of the contact elements, is located in said single unit.

2. The connector of claim 1, wherein the parts (2, 3; 2*a*, 3*a*; 2*b*, 3*b*) of the single unit are interlocked with one another.

3. The connector of claim 1, wherein the slit-blade insulation piercing (SBIP) connector (18) is located substantially in a portion of the parting face (5).

4. The connector of claim 1, wherein at least one of said connections (14*a*) is formed as a screw connection.

5. The connector of claim 1, wherein at least one of said connections (16) is formed as a screwless connection.

6. The connector of claim 5, including externally actuatable disconnecting means (38) for said external electrical conductors, selectively engagable with the screwless connection (16).

7. The connector of claim 6, wherein the disconnecting means includes a disconnector key (38) movably supported in one part of the two-part housing.

8. The connector of claim 7, wherein the disconnector key (38) is located at an end (15) of the single unit, next to or under said screwless connection (16).

9. The connector of claim 7, wherein the disconnector key (38) is movably and captively supported.

10. The connector of claim 1, wherein said interengaging interlocking means (6, 7, 8; 10, 11) locking said two parts of the two-part housing (1; 1*a*; 1*b*) with one another are operative and located in a plane approximately parallel to a bearing face (4) of the connector.

11. The connector of claim 1, wherein at least one part (3) of the two-part housing is arranged for selective connection with a second housing part (2, 2*a*) that has various different connections (14).

12. The connector of claim 1, wherein one (19) of the connections is formed as a screwless connection, and located on a bearing face (4) of one of the at least two parts.

13. The connector of claim 12, wherein the said one of the connections (19) is arranged for connecting an upright tab (79) of a metal shim (71).

14. The connector of claim 1, including a contact part (60, 61, 200) that is connected to at least one contact spring (20; 20*a*; 20*b*) and protrudes outside of said housing or is accessible from outside of said housing.

15. The connector of claim 14, wherein the contact part (200) is located in the region of the bearing face (4).

16. The connector of claim 15, wherein at least one fastening means (55) is located in the region of the bearing face (4), and the contact part (200) is located on or in the fastening means (55).

17. The connector of claim 14, wherein the contact part is formed as a contact clip (60, 61), which is connected to the contact means (20) at one connection (40, 58) and located on the outside of the connector.

18. The connector of claim 17, wherein the contact clip (60, 61) is connected to a face-end connection (40, 58), which is located in particular below another connection (16) for lines.

19. The connector of claim 14, wherein the contact part (60, 61, 200) is arranged for contacting in a hole (72, 75, 203) of a metal shim (71).

20. The connector of claim 19, wherein the contact part (60, 61, 200) is formed with lateral sharp edges (69, 73, 202), which can be brought into engagement with the hole boundary in order to establish an electrical contact.

21. The connector of claim 19, wherein the contact part (60, 61, 200) is formed or provided with means (67, 76, 55) for interlocking in the hole of the shim (71).

22. The connector of claim 21, wherein the contact part (61) is bent on its end in approximately a part of an arc or a V and is formed to be clampable by its edges (73) at three points of the hole boundary (FIG. 6).

23. The connector of claim 1, wherein the connector has devices (114, 114') on its face end for selective fastening of strain relief means (105) for conductors to be connected.

24. The connector of claim 23, wherein the connector has connection openings, indentations, channels or conduits (114, 114') located on the face end, which are arranged to receive insertable fastening parts (112) of strain relief means.

25. The connector of claim 24, wherein the fastening parts (112) of the strain relief means are formed to be insertable selectively into the detent openings, indentations, channels or conduits (114, 114') of two interengaged single units or between adjacent single units.

26. The connector of claim 25, wherein, as a function of the insertion of the fastening elements (112), the strain relief means is aligned either centrally with the face end of a single unit or with the region between two adjacent single units.

27. The connector of claim 1, wherein the connector is provided with a laterally disposed device (92) for receiving an operating means, in particular a fine-wire fuse (95).

28. The connector of claim 27, wherein the device has an additional housing (92), which includes the contact means (97) for the operating means (95).

29. The connector of claim 28, wherein the additional housing (92) is formed as a separate part and is disconnectably joined, in particular interlocked, with the housing (1, 1*a*, 1*b*) of the connector.

30. The connector of claim 28, wherein the additional housing (92) is formed onto the housing (1, 1*a*) of the connector.

31. The connector of claim 29, wherein the additional housing (92) is assigned a closure element (100), which is disconnectably joined to the additional housing (92).

32. The connector of claim 1, wherein the coupling devices have complementary tongue and groove elements (50, 51), located on opposed sides of the housing (1, 1*a*), which are oriented transversely to the bearing face (4) and which are optionally assigned detent means (53, 54).

33. The connector of claim 32, wherein the tongue and groove elements (50, 51) are designed for a coupling device that points away from the bearing face (4) and is oriented from the bottom upward, and have a stop in the coupling direction.

34. The connector of claim 12, wherein said interengaging interlocking means (6, 7, 8; 10, 11) locking said two parts of the two-part housing (1; 1*a*; 1*b*) with one another are operative and located in a plane approximately parallel to a bearing face (4) of the connector.

35. Multi-pole terminal or coupling connector, which comprises a plurality of single- or multi-pole single units as claimed in claim 1, wherein, in accordance with the invention, each of said single units are positively coupled with one another and at least some of them, or groups of them, have the same or different functions.

36. A set of modular electrical terminal and coupling connectors to form multi-pole electrical connections, said set comprising a plurality of single- or multi-pole terminal and coupling connector units each having a plurality of connections (14, 16, 18), of which at least one (18) is formed as a slit-blade insulating piercing connector arranged for automatic wiring; and wherein at least one other connection (14, 14*a*) is formed as a screw connection or a screwless connection, and wherein, in accordance with the invention, all the single units have identical laterally located interengaging means (50, 51), which are arranged for positive coupling of single units, of the same or different function, lined up with one another to make multi-pole connectors or connector strips.

37. The set of claim 36, wherein the set contains said terminal or coupling connectors as its single units.

* * * * *